United States Patent [19]

Harada et al.

[11] Patent Number: 4,548,522

[45] Date of Patent: Oct. 22, 1985

[54] PRINT HEAD FOR A DOT MATRIX PRINTER

[75] Inventors: Mineo Harada; Tetuzi Simojyo, both of Owariasahi; Kaname Furuya, Kasugai, all of Japan

[73] Assignee: Hitachi, Ltd., Tokyo, Japan

[21] Appl. No.: 527,360

[22] Filed: Aug. 29, 1983

[30] Foreign Application Priority Data

Aug. 27, 1982 [JP] Japan ..... 57-147635

[51] Int. Cl.[4] ..... B41J 3/12

[52] U.S. Cl. ..... 400/124; 101/93.05; 335/274

[58] Field of Search ..... 400/124, 157.2, 157.3; 101/93.05, 93.48; 335/274

[56] References Cited

U.S. PATENT DOCUMENTS 3,991,869 11/1976 Berrey ..... 400/124
4,134,691 1/1979 Matschke ..... 101/93.05 X
4,368,353 1/1983 Ando et al. ..... 400/124 X

FOREIGN PATENT DOCUMENTS 36466 3/1983 Japan ..... 400/124

OTHER PUBLICATIONS

*IBM Tech. Disc. Bulletin,* Lisinski, vol. 21, No. 1, Jun. 1978, pp. 18, 400–124.

*Primary Examiner*—Paul T. Sewell
*Attorney, Agent, or Firm*—Antonelli, Terry & Wands

[57] ABSTRACT

A print head wherein a magnetic member is attracted by a permanent magnet to bend a resilient member to thereby store energy in the resilient member. A magnetic force of the permanent magnet is adapted to be cancelled by an excitation of an electromagnet to release the magnetic member thereby enabling the utilization of the energy stored in the resilient member as an impact force for printing. A rear end portion of the resilient member is pressed in a direction opposite to a direction in which the impact force is applied by a pressing member and is adapted to pivot with a certain degree of freedom. The pivoting fulcrum for the magnetic member is defined on a magnetic pole surface of the permanent magnet. At least one of the contact portions of the pressing member or the resilient member is provided with a curved surface in an engagement area of the pressing member and resilient member, and a distance between the contact point and the pivoting fulcrum is variable in accordance with the pivoting movement of the magnetic member so that it is possible to provide a control whereby the impact force is constant.

14 Claims, 11 Drawing Figures

PRINT HEAD FOR A DOT MATRIX PRINTER

BACKGROUND OF THE INVENTION

The present invention relates to a print head and, more particularly, to a printing mechanism of a print head in a dot matrix printer.

Dot matrix printers are widely used as a device adapted to print the character, figure, and the like on print paper by a combination of dots and, known printers of this type include ink jet printers, thermal printers, wire matrix printers, and the like.

A so-called serial type wire matrix printer is the best known and most widely used, with such printer being adapted to print a character or the like on paper set on a platen while moving a wire styli dot matrix print head in parallel to the platen. The wire styli dot matrix head includes seven or nine wire styli arranged in a predetermined manner and guided so that each wire stylus lies in one or two rows at the end portion of the print head. The print head forms dots on a paper by selectively driving electomagnets which correspond in number to the wire styli so that the wire styli are sprung or forced out from the end portion of the print head through respective movable members such as armatures.

Wire styli dot matrix print heads of the aforementioned kind are divided into two types in dependence upon the manner of driving the movable members. One type of print head, described, for example, in U.S. Pat. No. 4,004,673, is called an "attraction type" print head wherein the armatures are attracted by respective electromagnets electrically driven to thereby operate the respective wire styli. The other type of print head described, for example, in U.S. Pat. Nos. 4,044,668 and 4,225,250, are called "cancel type" print heads. More particularly, in the cancel type print heads, a resilient member, having one end thereof fixed, is previously bent by being attracted by a permanent magnet, with the attraction force of the permanent magnet being canceled by the magnetic flux of an electromagnet so that the strain energy stored in the resilient member is applied to the corresponding wire stylis as a printing force.

As compared with the electromagnet attraction type print head, the cancel type print head generates smaller amounts of heat when the printer is on standby and can advantageously ensure a large attraction force by even a small sized permanent magnet. Consequently, the cancel type print head is more suitable for practical use.

In the cancel type print head, a strain energy is stored by bending the resilient member, which energy is employed to drive or fly the corresponding print wire stylis. More specifically, the resilient force of the resilient member is nothing but the printing energy for the printing wire stylis; therefore, the size of the resilient force of the resilient member has a significant effect on the overall printing quality of the print head.

On the other hand, in order to ensure an excellent printing quality in a printer employing a cancel type print head, the resilient force of the resilient member must be regulated so as to enable a realization of an optimum value with respect to variations of each of the magnetic flux amount of permanent magnet and the excitation force of the electromagnet.

Unfortunately, it is exceedingly difficult to regulate and control the amount of resilient force. In this connection, even if the amount of the magnetic flux of each permanent magnet or the excitation force of each electromagnet is constant, it is impossible to obtain uniform forces on the entire resilient members due to the difference in plate thickness between the resilient members or the difference in connection between magnetic members connected to the respective resilient members, that is, a difference in the amount of brazing material used to attach the magnetic member to the respective resilient members. In other words, even if the resilient members are given constant deflection amounts, it will be impossible to obtain a constant strain energy and, consequently, a constant printing quality cannot be obtained for each wire stylis.

SUMMARY OF THE INVENTION

The aim underlying the present invention essentially resides in providing a dot matrix print head which exhibits excellent printing qualities.

In accordance with advantageous features of the present invention, a dot matrix print head is provided in which a printing energy is stored by bending a resilient member such as, for example, a plate spring, with magnetic attraction force of a permanent magnet being cancelled by exciting an electromagnet to thereby apply the printing energy stored in the member to a printing element as an impact force. A magnetic member, functioning as an armature, is fixed to one end of the resilient member, with the printing element being directly or indirectly fixed to the magnetic member. The magnetic member is attracted to the permanent magnet to bend the resilient member with the opposite end of the resilient member being free. A pressing member is provided in order to press the free end portion of the resilient member in a direction opposite to a direction in which the impact force is applied.

According to the present invention, the pressing member may, for example, be a screw, with the pressing force on the resilient member being regulated by an adjusting rotation of the screw. Moreover, at least either one of an end of the screw and a portion of the resilient member with which the screw end comes into contact has a curved surface. Preferably, the screw end is formed into a spherical shape which is adapted to be brought into contact with a bore provided for engagement with a resilient member. Consequently, the pressing force on the resilient member varies in dependence upon the amount of rotation of the screw and a position of contact between the screw end and the resilient member may be varied or changed in small increments. In other words, the point at which the screw presses the resilient member changes.

Preferably, in accordance with still further features of the present invention, the resilient member is formed so as to have at least one minute portion bent in a direction perpendicular to a longitudinal direction of the resilient member so that the resilient member is slightly expanded or contracted longitudinally thereof.

Moreover, according to the present invention, a pivoting fulcrum of the magnetic member is formed on the magnetic pull surface of the pemanent magnet, for example, the magnetic pull surface of the yoke which forms a magnetic circuit together with the magnetic member. Additionally, a distance between the pivoting fulcrum and the point at which the pressing member presses on the resilient member is variable in accordance with the pressing force on the resilient member.

According to the present invention, the resilient members are independently arranged so as to correspond in number to the plurality of printing elements and a rearend portion of the resilient members have some degrees of freedom. Moreover, a distance between the point at which the pressing member is effective and the pivoting fulcrum of the magnetic member is variable in accordance with the pressing force of the pressing member and thereby the strain energy of each resilient member can be maintained constantly. Thus, the energies applied to the respective printing elements are uniform and it is possible to obtain a wire styli dot dot matrix print head which is excellent in printing quality.

Accordingly, it is an object of the present invention to provide a print head which avoids, by simple means, short comings and disadvantages encountered in the prior art.

Another object of the present invention resides in providing a print head which exhibits excellent printing quality.

Yet another object of the present invention resides in providing a dot matrix print head capable of storing a substantially constant printing energy in each resilient member thereof by means of a magnetic force of an associated permanent magnet.

A still further object of the present invention resides in providing a wire styli dot matrix print head having a plurality of independent resilient members corresponding in number to the printing elements, with the wire styli being arranged such that an end portion of each resilient member more remote from the corresponding printing element has some degress of freedom.

This and other objects, features, and advantages of the present invention will become more apparent from the following description when taken in connection with the accompany drawings which show, for the purpose of illustration only, several embodiments in accordance with the present invention.

DETAILED DESCRIPTION

Figure 1:
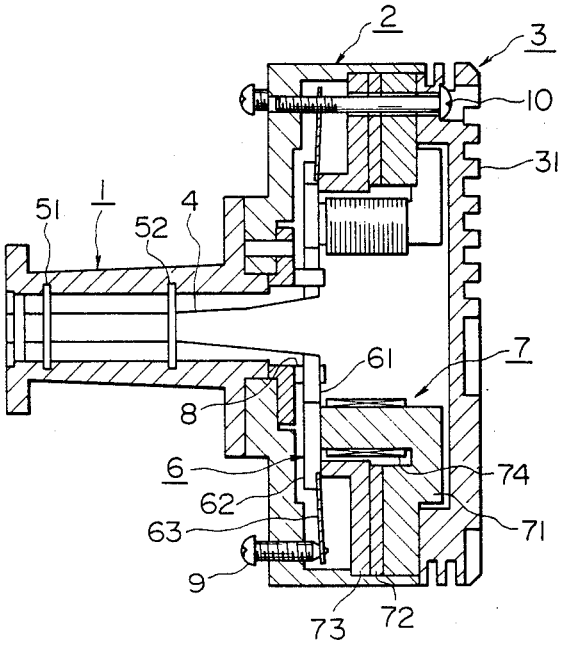
FIG. 1 is a cross sectional side elevational view of a wire styli dot matrix print head constructed in accordance with the present invention.
Figure 2:
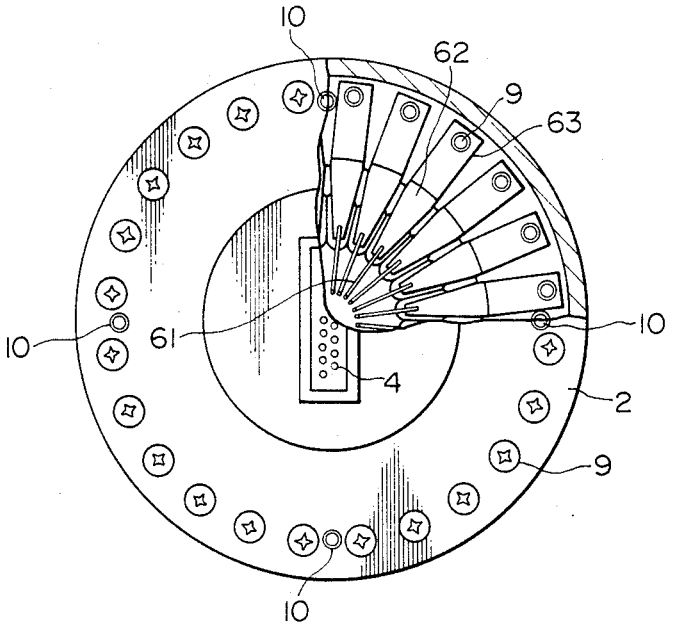
FIG. 2 is a partial cross sectional plan view of the print head of FIG. 1 as viewed from the left hand side thereof.

Referring now to the drawings wherein like reference numerals are used throughout the various views to designate like parts and, more particularly, to FIGS. 1 and 2, according to these figures, a wire dot matrix print head having twenty-four wire styli is provided. In this connection, while a wire dot matrix print head having seven or nine wire styli is sufficient for printing English letters, Arabric numerals, and the like, for printing Chinese characters, a larger number of dots are needed so that a print head having sixteen or twenty-four wire styli is generally required. The print head includes an outer frame structure constituted by a nose frame generally designated by the reference numeral 1, a housing frame generally designated by the reference numeral 2, and an outer plate generally designated by the reference numeral 3. The nose frame 1 is provided with guides 51, 52 adapted to guide a twenty-four wire styli in a predetermined manner, with the guides 51, 52 each having through holes for enabling wire styli 4 to pass therethrough. The wire styli 4 are guided so as to form two rows at the end portion of the print head. The outer plate 3 is made of a metal material such as, for example, aluminum or the like and has a heat sink 31 for radiating heat generated inside the print head to the outside.

Figure 3:
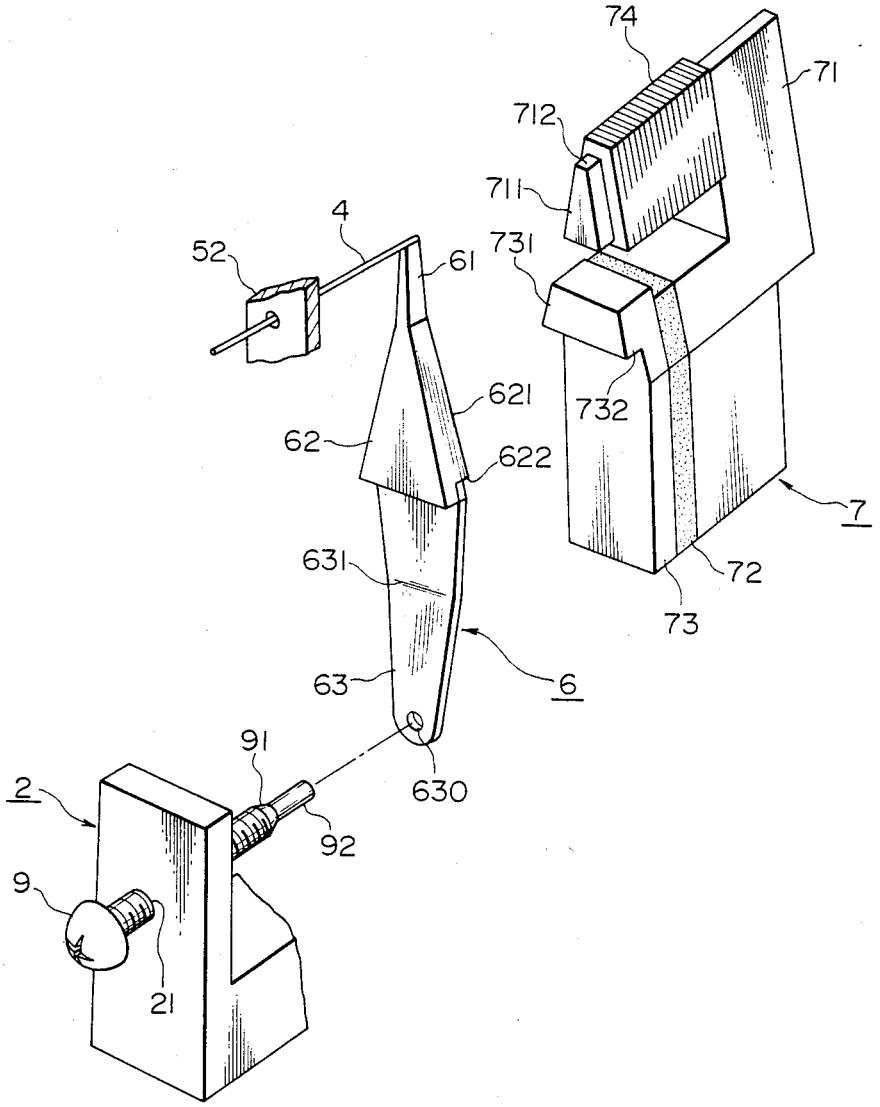
FIG. 3 is an exploded perspective view of a printing mechanism of the print head of FIG. 1.

A printing mechanism is disposed in a space defined by the housing frame 2 and the outer plate 3, with the printing mechanism including, as shown most clearly in FIG. 3, lever units generally designated by the reference numeral 6 and driving mechanisms generally designated by the reference numeral 7 for the lever unit 6, with the number of lever units 6 and driving mechanism 7 corresponding to the number of wire styli 4. For example, with twenty-four wire styli 4, twenty-four lever units 6 and twenty-four driving mechanism 7 are respectively paired and associated with the respective wire styli 4, with all of the lever units 6 and driving mechanisms 7 being disposed in the housing frame so that the wire styli 4 are concentric with each other in a central portion thereof.

As shown most clearly in FIG. 3, the lever unit 6 includes a lever body 61, a magnetic member 62 and a plate spring member 63, with the lever body 61 having a wire stylus 4 secured to the top end thereof, by, for example, brazing or the like. The lever body 61 is secured, for example, by brazing or the like, to one end of the magnetic member 62, with a resilient member such as, for example, a resilient spring member 63 being secured to the other end of the lever body 61 by, for example, brazing or the like.

While the spring member 63 may be constituted by a resilient metal material such as, for example, a stainless steel, preferably, Elgiloy is used due to the mechanical strength thereof and the problems of heat exposure due to the brazing operation. Additionally, although the magnetic member 62 is generally constituted by a magnetic material such as, for example, iron, a silicon steel is preferable taking into consideration the statutated magnetic characteristics or the like.

It is also possible in accordance with the present invention to eliminate the brazing operation and brazing material required for bonding the lever body 61 to the magnetic member 62 by elongating the magentic member 62 to the portion of the lever body 61 so that the wire stylus 4 may be secured to a apex of the magnetic member 62. However, since there exists a strong demand for increasing the printing speed of the print head, to attain an increase in the printing speed, preferably the stainless steel lever body 61 is bonded to the apex of the magnetic member 62 so as to reduce the weight of the lever unit 6 as much as possible.

The twenty-four lever units 6 thus arranged are disposed concentrically and close to each other, with the wire styli 4 thereof directed toward the center. For this reason, each of the lever bodies 61 and the magnetic members 62 take the form of an isosceles triangle or a fan shape. The spring member 63 and a magnetic member 62 are connected in such a manner so as to be disposed in a plane substantially parallel to the magnetic attraction working surface 621 of the magnetic member 62. In this case, a corner 622, to be described more fully hereinbelow, of the magnetic member 62 contacts the magnetic surface 731 of the yoke 73 to define a pivoting fulcrum.

A bore 630, for regulating the spring force, is formed in a rear end portion of the spring member 63. Additionally, a central portion of the spring member 63 is slightly curved to form a curved portion 631. Accordingly, the rear end portion of the spring member 63 is slightly curved toward the end of the printing head, that is, toward the screw 9 in a manner described more fully hereinbelow. The spring member 63 need only be slightly curved and it is unnecessary to define a clear line such as shown by the curved portion 631 in FIG. 3.

The driving mechanism 7 for the lever unit 6 includes a first yoke 71 of a predetermined shape having a core portion 712 integrally formed therewith, a permanent magnet 72 fixed to the first yoke 71 and a second yoke 73 fixed to the other side of the permanent magnet 72. The core portion 712 is wound with a coil 74 to form an electromagnet. Additionally, a front end surface of the core portion 712 defines a magnetic pole surface 711. A protrusion 732 is provided on the side of the second yoke 73 facing the lever unit 6 and has the upper side surface thereof defining a magnetic pole surface 731.

The first yoke 71, permanent magnet 72, and second yoke 73 form a unitary body, and the twenty-four assemblies, each formed as unitary bodies, are disposed concentrically and clamped between the outer plate 3 and the housing frame 2, and are secured by bolts 10 (FIGS. 1, 2).

Bores 630, equal in number to the number of wire styli 4, that is, in the illustrated embodiment, twenty-four are formed in a bottom portion of the housing frame 2 at an equal spacing from each other and along the same circumference, with the screws 9 being received by the respective bores 630. Each screw 9 is adapted to press a rear end portion of the corresponding spring member 63 so as to enable a regulation of the spring force thereof for the rotation of the respective screws 9. More particularly, each screw 9 has a hemispherical surface or spherical portion 91 provided on one end thereof as well as a projection 92 formed in a central area of the spherical portion 91. As clearly shown in FIG. 3 or 4, the spring member 63 is pressed by the screw 9 and rotatably supported thereby with a certain degree of freedom. Accordingly, the spherical portion 90 of the screw 9 is constantly contacted by the edge portion of the bore 630 formed in the spring member 63 and, moreover, the projection 92 is adapted to prevent the spring member 63 from being displaced longitudinally thereof. Since each lever unit 6 has a certain degree of freedom in a planar direction thereof, in order to prevent the rocking of the lever unit 6, especially when the lever unit 6 pivots, a comb tooth-shaped guide 8 (FIG. 1) is provided in a central portion of the housing frame 2.

Thus, the lever unit 6 and driving mechanism 7 are paired and disposed inside the housing frame 2. In the illustrated embodiment, the lever unit 6 and driving mechanism 7 are disposed so that the magnetic pole surface 621 of the magnetic member 62 faces both the magnetic poles surface 711 and core portion 712 and the magnetic surface 621 of the magnetic member 62. Moreover, the corner 622 of the magnetic member 62 is brought into contact with the magnetic pole surface 731 so that the pivoting fulcrum of the lever unit 6 is defined on the magnetic pole surface 731. The pivoting fulcrum is defined on the magnetic pole surface 731 in order to reduce the distance between the fulcrum and the top end portion of the lever unit 6 as much as possible thereby enabling a higher speed operation of the lever unit 6.

With a construction such as described hereinabove, in a normal state, the magnetic member 62 is attracted to the magnetic pole surface 731 of the yoke 73 as well as the magnetic pole surface 711 of the core portion 712 by the magnetic flux generated by the permanent magnet 72 and thereby the spring member 63 is bent to store energy. The strain energy of the spring member 63 is regulated by the adjustable insertion of the screw 9. More particularly, if the screw 9 is adjusted so that the pressure point of the screw 9 on the spring member 63 is along the same plane as the magnetic pole surfaces 711, 731, then the spherical portion 91 and bore 630 uniformly come into contact with each other, which is desireable from a view point of wear and stability.

Under the above described state, when the coil 74 is supplied with a current, a magnetic force is generated in the core portion 712 and the magnetic flux of the permanent magent 72 is cancelled by the magnetic force. Thus, the magnetic member 62 is displaced by the spring force of the spring member 63 while rotating about the fulcrum defined by the corner 622 of the magnetic member 62. Consequently, the wire stylus 4 is guided by the guide 52, 51 and the end thereof springs out from the end portion of the print head to strike a printing paper through an ink ribbon thereby resulting in the printing paper being printed with a dot constituting a character.

In the printing operation described hereinabove, the spring member 63 exhibits a canitilever-like deflection curve between the connecting portion with the magnetic member 62 and the engaging portion with the screw 9; therefore, no stress larger than that which is required will act thereby advantageously preventing breakage or the like of the print head.

Figure 4:
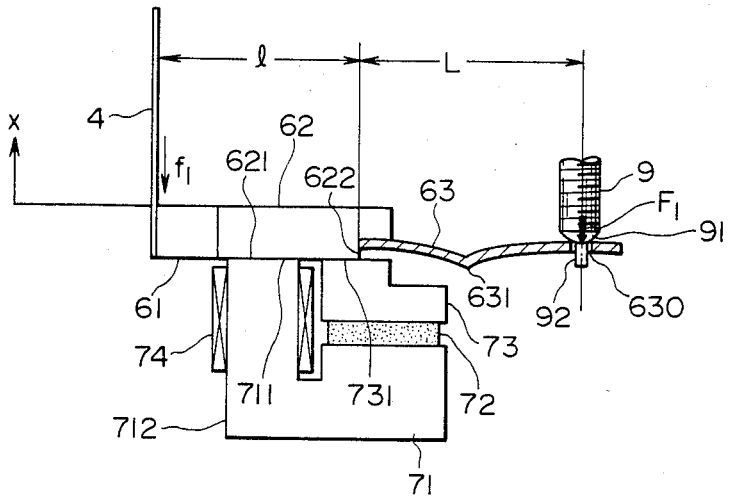
FIG. 4 is a side elevational view of a lever unit of the print head of FIG. 1.

Additionally, the pivoting fulcrum of the lever unit 6 is, as described hereinabove, the corner 622 of the magnetic member 62, and the radius of rotation of the lever unit 6 is defined by a length l from the corner 622 to the wire stylus 4 as shown in FIG. 4, with the length l being extremely smaller than a corresponding length in prior art constructions where the rear end portion of the plate spring is fixedly supported. Consequently, the moment of inertia of the lever unit is small thereby making it possible to increase the printing speed. Moreover, the magnetic member 62 is pressed against the magnetic pull surface 731 of the yoke 73 by the traction force of the permanent magnet 72 and a component force of the pressing force by the screw 9 so that the pivoting fulcrum of the lever unit 6 has a very small variation.

In the print head described hereinabove in which printing is effected by accelerating the magnetic member 62 by means of the strain energy stored in the spring member 63, the strain energy stored in the spring member 63 is an exceedingly important factor in ensuring a stable printing force or a stable operation for a constant operating time, and the above described embodiment is very advantageous on this point.

FIG. 4 more clearly illustrates the relationship between the lever unit 6 and the pressed portion of the spring member 63. More particularly, the spring force of the spring member 63, fixed to the magnetic member 62 in the lever unit 6, is regulated by the screw 9 so as to have a predetermined spring force under a state where the magnetic attraction working surface 621 of the magnetic member 62 is attracted to both the magnetic pole surface 711 on the core portion 712 and the magnetic pole surface of the yoke 73. The spring member 63 is previously provided with predetermined curved portions 631 so that the plane of the pressed portion of the spring member 63 is substantially parallel to the plane in which the magnetic pole surfaces 711, 731 of the core portion 712 and the yoke 73 are disposed when the magnetic attraction working surface 621 of the magnetic member 62 is attracted to the magnetic pole surfaces 711, 731. In this situation, the speherical portion 91 of the screw 9 contacts with the substantially central portion of the bore 630 formed in the spring member 63 so that the pivoting fulcrum to the contact point between the spring member 63 and the spherical portion 91 of the screw 9 to the corner 622 of the magnetic member 62 is at a predetermined distance L. Here a force $F_1$ of the screw 9 pressing the spring member 63 is determined by the material or dimensions, shape and deflection amount of the spring member 63. Since the force for accelerating the magnetic member 62 is determined by the force $F_1$, if the force $f_1$ is converted, as the force acting on the magnetic member 62, into the position for the wire stylus 4 mounted on the apex of the lever body 61, then the following relationship is obtained:

$$f_1 = \frac{L}{l} F_1,$$

where $f_1$: the force action in the wire stylus position;

l: the distance between the pivoting fulcrum of the magnetic member to the bonded position of the wire stylus 4; and $F_1$: the pressing force on the spring member 63.

When the coil 74 is supplied with a current to cancel the magnetic flux of the permanent magnet 72, the magnetic member 62 is pivoted about the corner by the spring force, causing the wire stylus 4 to be driven. Since the deflection amount of the spring member 63 is decreased in accordance with this operation, the accelerating force applied to the magnetic member 62 is lowered.

Figure 7:
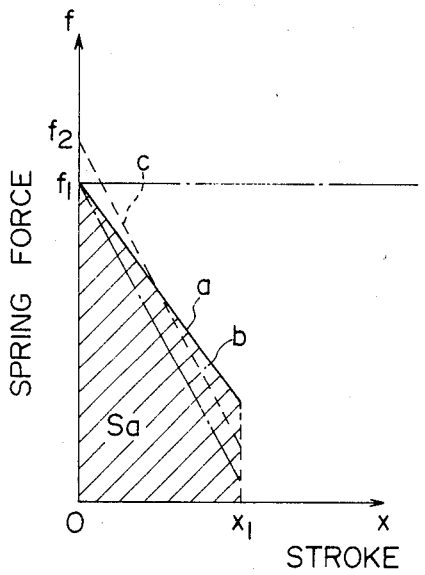
FIGS. 7 and 8 are graphical illustrations of a relationship between the operating stroke and spring force.

FIG. 7 illustrates the relationship between the operating amount of the wire stylus 4, that is, the operating stroke (abscissa) and the spring force f (ordinate) converted into the position of the wire stylus 4. The wire stylus 4 flies or is displaced by a predetermined operating stroke to strike against the printing paper. Since, at this time, the printing energy is generated by the strain energy stored in the spring member 63, the printing energy is applied according to the product of the spring force and the operating stroke, that is, the shaded or hatched area Sa of FIG. 7.

For stabilizing the high speed printing performance, it is extremely important to reduce the variations of the printing energies for a plurality of wire styli 4 and the maintain the printing energies constant. If the value of the printing energy fluctuates, the capacity of accelerating the wire stylus 4 varies so as to cause the printing force to differ in intensity thereby resulting in differences betweeen impact foces. Additionally, the operating time also varies so that it becomes impossible to repeat the operation in a predetermined cylce. Consequently, there is an impairment in the high speed printing performance.

It is possible to regulate the variations of the printing energy by altering the deflection amount of the spring member 63 through an adjustment by the screw 9; however, such regulation is still incomplete if the distance L from the contact point between the spring member 63 and the screw 9 to the corner 622 of the magnetic member 62 is constant.

Figure 5:
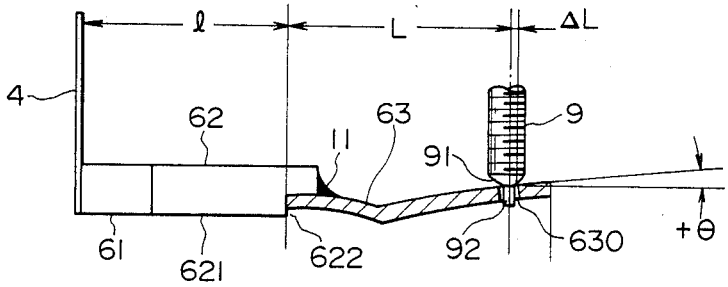
FIG. 5 is a side elevational view of a driving mechanism of the print head of FIG. 1.
Figure 6:
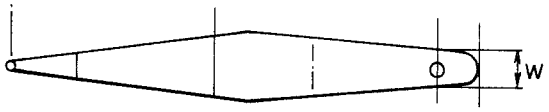
FIG. 6 is a plan view of the driving mechanism in FIG. 5, as viewed from a lower side thereof.

FIGS. 5 and 6 provide an illustration of the state where the characteristic value of the spring member 63 varies from a standard value. More particularly, it is assumed that the plate thickness of the spring member 63 is larger than a standard size, that the spring member 63 and the magnetic member 62 are connected to each other by brazing, and that the amount of brazing material varies so that a large fillet 11 is attached to the magnetic member 62 and the spring member 63. The characteristic value of the illustrated spring member 63 is represented by the line designated b in FIG. 7. In such a state, the spring 63 has a spring constant larger than that of a standard spring member represented by the line a in FIG. 7 and, consequently, can generate the same spring force with a deflection amount less than a deflection amount of the standard spring member. However, under this state, if the pressing force F on the spring member 63 is regulated so as to be the same as the force $F_1$ as that on the standard spring member, although the spring force f converted into the position of the wire stylus 4 is substantially equal to the force $f_1$, the spring force f suddenly becomes smaller with respect to the operating stroke since the spring constant is larger. This relationship is linear as shown by the line b in FIG. 7, and the strain energy of the spring member becomes smaller than that of the standard spring member as shown by the line a. In otherwords, the printing energy is lowered and the impact forces becomes unstable so that a dot may not be printed. Under such conditions, if, through an adjustment of the screw 9, the pressing force on the spring member is regulated so as to be larger in order to ensure a strain energy substantially equal to that of the standard spring member, it is possible to regulate the pressing force F so as to be in the same area as that of the strain energy obtained by the standard spring member as shown by the line c in FIG. 7. However, since the regulated pressing force $F_2$ is larger than the force $F_1$, the spring force $f_2$ converted into the position of the wire stylus 4 becomes larger than the force $F_1$, and the difference between the forces $F_1$, $F_2$ is large. Therefore, the difference between the spring force $f_2$ and the magnetic traction force becomes large so that a point in time wherein the magnetic member starts to operate is variable. Consequently, a stable operation cannot be obtained, and an operation failure due to magnetic interference may result.

The spherical portion 92 at the end of the screw 9 effectively acts for the spring member 63 in the manner described hereinabove. The spring member 63 shown in FIGS. 5 and 6 has a spring constant larger than that of a standard spring member and hence can generate a spring force substantially equal to a predetermined spring force even if the deflection amount is relatively small. Under these conditions, the deflection angle of the rear end portion of the spring member 63 is at an angle of inclination of $+\theta°$. Accordingly, the contact point between the screw 9 and the spring member 63 is displaced from a center of the bore 630 in the spring member 63 by a predetermined amount $\Delta L$, and the screw 9 and spring member 63 come into contact with each other at a position displaced by the amount $\Delta L$. In other words, a distance from the contact point to the pivoting fulcrum lever unit 6 is larger than that of the standard spring member by the amount $\Delta L$, i.e., $L+\Delta L$. If it is assumed that under these conditions the pressing force is $F_2$, the spring force $f_2$ converted into the position of the wire stylus 4 has the following relationship:

$$f_2 = \frac{L + \Delta L}{l} F_2.$$

On the other hand, the inclination of the spring force with respect to the operating stroke at the position of the wire stylus 4, i.e., the spring constant converted into the position of the wire stylus 4 is lowered, since the spring member 63 is pressed at a point located at a position which is L further than where the spring member 63 is pressed at a point at a distance L from the pivoting fulcrum 622. More specifically, the spring constant K is represented by the following equation:

$$K = \frac{wt^3E}{4\alpha L^3} \text{ (Kg/mm)},$$

where $\alpha$: a shape coefficient;

t: the plate thickness of the spring member 63;

E: the Young's modulus; and w: the contact width of the spring member 63,

As evident from the above equation, if the distance L becomes $L+\Delta L$, the spring constant K is lowered. Thus, when the spring constant is lowered, the lowering of the spring force with respect to the operating stroke becomes more gradual. Accordingly, for the spring member 63 in such a condition, it is possible to ensure the same strain energy as in the case of a standard spring member under a constant stroke condition by setting the pressing force on the spring member 63 so as to be slightly larger than the pressing force $F_1$ on the standard spring member. Additionally, as compared with a spring member having a fixed pressing point, the spring member 63 can reduce the difference between the spring force value for obtaining the same strain energy. In other words, where the screw 9 is provided with the spherical portion 91, it becomes possible to decrease the difference between the regulated spring forces for a plurality of springs as represented by the line d in FIG. 8.

Figure 8:
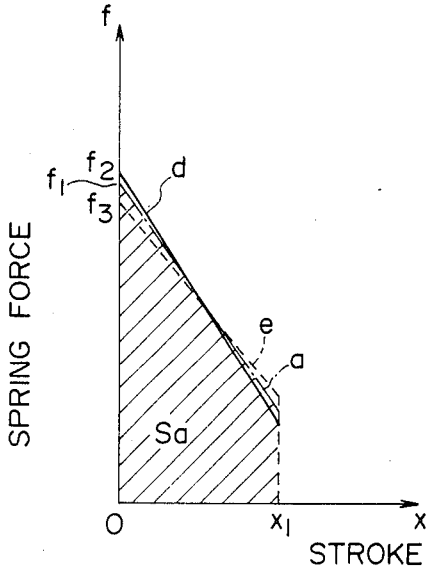

As shown by the line e in FIG. 8, the above holds true in situations wherein a plate thickness of the spring member 63 is smaller than that of a standard spring member represented by the line a in FIG. 7, i.e., in the case where the spring constant of the spring member is decreased. In such a case, the point of pressing on the spring member 63 by the spherical portion 91 at the screw 9 is nearer to the pivoting fulcrum by the predetermined amount $\Delta L$ than in the case of a standard spring member. Additionally, the spring member 63 is pressed so that the rear end portion of spring member 63 has a deflection angle of $-\theta°$. Since a magnetic attraction of the permanent magnet 72 is inversely proportional to a square of the air gap, the attraction force decreases in a second degree curved manner as represented by the curve r in FIG. 9 with an increase in the operating stroke.

Figure 9:
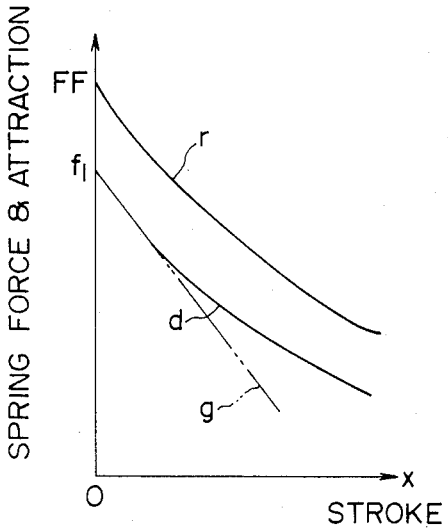
FIG. 9 is a graphical illustration of a relationship between the operating stroke and attraction force.

In FIG. 9, the curve g represents the spring force in previously proposed arrangements wherein one end of the spring member 63 is fixed. On the other hand, the spring force of the spring member in accordance with the present invention varies in a different manner. More particularly, as noted hereinabove, since the contact point gradually changes, the spring constant gradually decreases with an increase in the operating stroke. For this reason, as shown by the line d in FIG. 9, if the operating stroke increases, there is a small change in difference between the attraction force and the spring force so that it is possible to obtain stable printing quality. Thus, the present invention advantageously enables a high speed printing operation.

As described hereinabove, according to the invention, the pivot point of the spring member 63 changes in a direction for easing variations of the spring constant of the spring member 63 due to the plate thickness thereof or the size of the fillet 11 attaching the spring member 63 to the magnetic member 62. Consequently, it becomes possible to obtain a stable printing quality and also, since the contact point between the bore 630 and the spring member 63 and the screw 9 is variable, there is no possibility of concentration of force on one point and therefore is less development of wear. Thus, it is possible to minimize the change over time of the impact energy which is an important characteristic in prolonging the service life of the print head.

Figure 10:
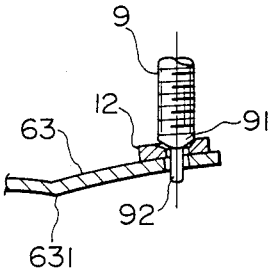
FIG. 10 is a cross sectional side elevational view illustrating a relationship between a spring member and an end of an adjustment screw of another embodiment constructed in accordance with the present invention.

As shown in FIG. 10, to provide for an engagement between the spring member 63 and the screw 9, a washer 12 may be interposed between the spring member 63 and the screw 9, with the washer 12 having a spherical surface portion adapted to come into contact with the spherical portion 91 of the screw 9, and with a lower surface adapted to be brought into close contact with the spring member 63. By virtue of the interposition of the washer 12, it is possible to further improve the wear resistance of the print head. Moreover, if the spherical portion 91 of the screw 9 and the washer 12 are subjected to a hard wearing surface treatment such as hard chrome plating, chemical nickle plating, or the like, lives of the components can be prolonged so that the realiability of the print head is significantly improved.

Figure 11:
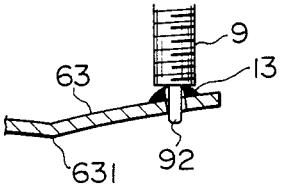
FIG. 11 is a cross sectional side elevational view illustrating a relationship between a spring member and an end of an adjustment screw in a still further embodiment of the present invention.

While the screw 9 has been described hereinabove as provided with an end portion formed into a spherical shape, it is possible for the end portion of the screw 9 to also have a substantially planar shape, with the spring member 63 being provided with a spherical portion. Moreover, it is also possible, as shown most clearly in FIG. 11, to provide a washer 13 in the engagement area between the screw 9 and the spring member 63, with an upper portion of the washer 13 being formed into a spherical shape.

Furthermore, although the screw 9 is provided on the end of the spherical projection 91 with a projection 92 for engagement with the bore 630 in the spring member 63, the projection 92 may be eliminated since, by virtue of the resilient force of the spring member 63 and pressing force of the screw 9, the spherical portion 91 and bore 630 are maintained in contact to such an extent that they are not separated from each other.

While we have shown and described several embodiments in accordance with the present invention, it is understood that the same is not limited thereto but is suspecptible of numerous changes and modifications as known to one having ordinary skill in the art and we therefore do not wish to be limited to the details shown and described herein, but intend to cover all such modifications as are encompassed by the scope of the appended claims.

We claim:

1.

A print head for a dot matrix printer, the print head comprising:

a plurality of printing means;

a plurality of pivotally mounted magnetic members, each of said magnetic members having a printing means secured to a first end thereof;

a plurality of resilient means, one of said resilient means being secured at a first end to a second end of the respective magnetic members, and a bore means is provided in a second end of said resilient means;

a plurality of permanent magnets for respectively attracting said magnetic members;

yoke means mounted on each of said permanent magnets, said yoke means including a pivoting fulcrum means on a surface thereof facing the magnetic member for enabling the pivotal mounting of the respective magnetic members;

a plurality of electromagnetic means for cancelling an attraction force generated by said permanent magnets so as to enable a pivoting of said magnetic members; and pressing means respectively associated with said resilient means and having a curved head portion adapted to be brought into contact with said bore means with a predetermined degree of freedom to press the second end of each of said resilient means in a predetermined direction so as to enable a distance between the pivoting fulcrum means and a contact point between the curved head portion and said bore means to be varied in accordance with an amount of pivotal movement of the magnetic member.

2. A print head according to claim 1, wherein each of said resilient means includes at least one curved portion disposed such that an end of each resilient means is curved in a direction against the pressing force applied by said pressing means.

3. A print head according to claim 1, wherein said pressing means further includes a projection provided substantially at a center portion of said head portion of said pressing means, said projection being adapted to be accommodated in said bore means.

4. A print head according to claim 1, further comprising a washer means interposed between said resilient members and said head portion of said pressing means, said washer means being provided with a bore means for accommodating said projection and a surface portion for accommodating the head portion of the pressing means.

5. A print head according to claim 4, wherein the surface portion of said washer means is a curved surface complimenting the head portion of said pressing means.

6. A print head according to claim 1, wherein means are interposed between an end of said pressing means and said bore means for enabling the contact of said pressing means with said bore means with the predetermined degree of freedom.

7. A print head according to claim 6, wherein said means interposed between said pressing means and said bore means includes a washer means cooperable with the end of the pressing means.

8. A print head according to claim 7, wherein said washer means is secured to the resilient means, said washer means having a spherical shaped upper surface adapted to engage the end of the pressing means.

9. A print head according to claim 7, wherein said washer means includes a surface portion complimentary to the end of the pressing means.

10. A print head according to claim 9, wherein the end of said pressing means has a spherical head portion cooperable with the surface portion of said washer means.

11. A print head according to claim 1, wherein said curved head portion of the pressing means has a hemispherical configuration.

12. A print head according to claim 1, wherein said pressing means includes a screw.

13. A print head according to claim 4, wherein said curved head portion of the pressing means has a hemispherical configuration.

14. A print head according to claim 13, wherein said pressing means includes a screw.

* * * * *